US009061192B2

(12) United States Patent
Forsell et al.

(10) Patent No.: US 9,061,192 B2
(45) **Date of Patent: *Jun. 23, 2015**

(54) ELECTRONIC SCORING SYSTEM, METHOD AND ARMOR FOR USE IN MARTIAL ARTS

(75) Inventors: Justin Forsell, Annandale (AU); David Pysden, Waverley (AU)

(73) Assignee: CHIRON IP HOLDCO PTY LTD, Sydney (AU)

( * ) Notice: Subject to any disclaimer, the term of this patent is extended or adjusted under 35 U.S.C. 154(b) by 276 days.

This patent is subject to a terminal disclaimer.

(21) Appl. No.: 13/210,824

(22) Filed: Aug. 16, 2011

(65) Prior Publication Data

US 2012/0029667 A1 Feb. 2, 2012

Related U.S. Application Data

(63) Continuation of application No. 12/716,388, filed on Mar. 3, 2010, now Pat. No. 8,021,281.

(30) Foreign Application Priority Data

Oct. 23, 2009 (AU) ..... 2009905163
Nov. 24, 2009 (AU) ..... 2009101201

(51) Int. Cl.
*A63B 69/00* (2006.01)
*A63B 69/02* (2006.01)

(52) U.S. Cl.
CPC ..... *A63B 69/02* (2013.01); *A63B 69/004* (2013.01); *A63B 2220/53* (2013.01)

(58) Field of Classification Search
CPC ... A63B 69/004; A63B 69/02; A63B 2220/53
USPC ..... 463/7, 8, 47.1; 482/8, 12, 83, 84, 901
See application file for complete search history.

(56) References Cited

U.S. PATENT DOCUMENTS

| | | | | |
|---|---|---|---|---|
| 3,866,909 | A | 2/1975 | DeSantis | |
| 4,030,731 | A | 6/1977 | Delcayre | |
| 4,534,557 | A | 8/1985 | Bigelow | |
| 4,761,005 | A | 8/1988 | French et al. | |
| 4,824,107 | A | 4/1989 | French | |
| 4,974,833 | A | 12/1990 | Hartman et al. | |
| 5,533,404 | A | 7/1996 | Wurst et al. | |
| 5,570,881 | A | 11/1996 | Lau | |
| 5,716,302 | A | 2/1998 | Andersson | |
| 5,836,853 | A | 11/1998 | Marciano | |
| 6,056,674 | A | 5/2000 | Cook | |
| 6,508,747 | B1 * | 1/2003 | Cook | 482/83 |
| 6,611,782 | B1 | 8/2003 | Wooster et al. | |
| 6,669,601 | B2 * | 12/2003 | Marciano | 482/12 |

(Continued)

FOREIGN PATENT DOCUMENTS

| | | |
|---|---|---|
| CN | 2134210 | 5/1993 |
| CN | 101376056 | 9/2008 |

(Continued)

*Primary Examiner* — Jay Trent Liddle
(74) *Attorney, Agent, or Firm* — Leason Ellis LLP

(57) ABSTRACT

An electronic scoring system for use in a variety of martial arts (including traditional styles of martial arts, mixed martial arts, weapons based martial arts or the fighting arts generally). The scoring system allows an objective determination of the force, location and effectiveness of forces applied during competition, without the need for electric weaponry.

35 Claims, 5 Drawing Sheets

(56) References Cited

U.S. PATENT DOCUMENTS

| | | | | |
|---|---|---|---|---|
| 6,878,870 | B2 * | 4/2005 | Aldridge | 84/733 |
| 6,925,851 | B2 * | 8/2005 | Reinbold et al. | 73/12.09 |
| 7,001,272 | B2 * | 2/2006 | Yamashita et al. | 463/7 |
| 7,275,986 | B2 * | 10/2007 | Mori et al. | 463/8 |
| 7,278,290 | B1 | 10/2007 | Hughes et al. | |
| 7,384,380 | B2 | 6/2008 | Reinbold et al. | |
| 7,412,348 | B2 * | 8/2008 | Okamura | 702/152 |
| 7,433,805 | B2 * | 10/2008 | Vock et al. | 702/188 |
| 2004/0009851 | A1 | 1/2004 | Lovison | |
| 2004/0041828 | A1 * | 3/2004 | Zellhoefer | 345/706 |
| 2005/0209066 | A1 * | 9/2005 | Penney | 482/84 |
| 2005/0250625 | A1 * | 11/2005 | Reinbold et al. | 482/84 |
| 2005/0266967 | A1 | 12/2005 | Considine et al. | |
| 2006/0101988 | A1 | 5/2006 | Aldridge | |
| 2007/0021219 | A1 | 1/2007 | Wu | |
| 2008/0146302 | A1 * | 6/2008 | Olsen et al. | 463/7 |
| 2008/0248871 | A1 | 10/2008 | Szturm | |
| 2008/0274819 | A1 | 11/2008 | Caldwell | |
| 2009/0033341 | A1 | 2/2009 | Son | |
| 2009/0091052 | A1 | 4/2009 | Pridie | |
| 2009/0137933 | A1 | 5/2009 | Lieberman | |
| 2009/0227906 | A1 | 9/2009 | Oster | |
| 2009/0235761 | A1 | 9/2009 | Song | |
| 2009/0270743 | A1 * | 10/2009 | Dugan et al. | 600/500 |

FOREIGN PATENT DOCUMENTS

| | | |
|---|---|---|
| DE | 202007010147 | 7/2008 |
| JP | 2003-038703 | 2/2003 |
| WO | WO 2007/011145 | 1/2007 |
| WO | WO 2009/025491 | 2/2009 |

* cited by examiner

FIG. 4A

DATE _____ TIME _____

ROUND _____

COMPETITION DETAILS _____

| BODY TARGET (Examples) | RATING (1 – 10) | ACTUAL IMPACT (Real Time psi – Range of 100 – 1500 psi) | DAMAGE (Black Red / Amber / Yellow / Green =Rating x Actual Impact | CUMULATIVE DAMAGE (Accumulated Damage) |
|---|---|---|---|---|
| Face / Nose | 6 | | | |
| Forehead | 2 | | | |
| Temples | 5 | | | |
| Jaw | 9 | | | |
| Throat | 10 | | | |
| Neck | 9 | | | |

70

A

A

ELECTRONIC SCORING SYSTEM, METHOD AND ARMOR FOR USE IN MARTIAL ARTS

CROSS-REFERENCE TO RELATED APPLICATIONS

This application is a continuation of U.S. patent application Ser. No. 12/716,388, filed Mar. 5, 2010 which is hereby incorporated by reference in its entirety

TECHNICAL FIELD

The present invention relates to electronic scoring systems, methods and armor for use in the martial arts, and in particular in weaponry-focused martial arts as well as the martial arts or martial-style arts generally.

BACKGROUND

The martial arts (e.g. karate, kendo or martial-style arts), including martial-style arts such as kick boxing, Brazilian Jiu Jitsu, fencing and other fighting arts, have a long tradition in many cultures. Martial arts are perhaps popularly recognised as originating from Asia but also have a long history in many other cultures and extend into modern culture today.

The martial arts are systems of codified practices and traditions of training for combat and may involve light- to medium-contact or full-contact sparring. Some forms of martial arts include the use of specialised weaponry (e.g. the shinai [Japanese sword] in kendo). In each case, a scoring system may be used that involves allocating points for striking identified "target" areas on the opponent's body with a specified part of the attacker's body (e.g. hand, foot, elbow or knee) or with a specified part of a weapon. For example, in kendo a point in competition is only awarded when the attack is made to a target area on the opponent's body and when the attack is made with the spirit, shinai and body as one. The shinai must strike the target soundly, including making contact with the top third of the shinai, with the direction of movement of the shinai being technically correct.

Currently the assessment of martial art combat technique is made visually by judges or through the incapacitation of an opponent. A key constraint in terms of visual judgement is the difficulty of observing attacks with the naked eye—for example, owing to the speed of the attack it may be difficult to accurately assess the location and force of the impact from an attack, or whether any real impact and damage was made (other than by reliance on physical cues such as a knockout or other incapacitating injury to a competitor). Human error and bias in refereeing are disadvantages with visual scoring systems. Another disadvantage is that close observation of attacks by a judge or referee carries the risk of serious injury or death, particularly when weaponry is involved.

The real risk of injury to competitors, particularly when weaponry is involved, has caused a decline in popularity of many martial arts in which full-contact combat or sparring is considered too dangerous (and/or unethical). This has led to full contact weapons-based competitions being restricted or prohibited in a number of countries. Thus some martial art systems are dying out through the lack of opportunity to compete in those martial arts safely.

Western fencing is an example of a martial-style art involving the use of weaponry (such as foils, epées, sabres—three kinds of swords used in Olympic fencing). Scoring involves landing a "hit" in a target area on an opponent. Ways used to overcome the difficulties of the visual scoring system used in fencing have included using ink on swords so that when an opponent's jacket is hit, it would stain and the number of "hits" could be counted. This method had the disadvantage that competitors could cheat by putting vinegar on their jackets so the ink would not show, thereby disguising the number of times a competitor had been hit.

To overcome the above problem, electronic scoring systems have been introduced. In fencing, for example, this involves an electrically conductive jacket (lamé) and mask defining the target (scoring) area and a push-button on the tip of the blade (or other form of pressure-sensitive tip). The electric weapon (foil, epée or sabre) in conjunction with the lamé form a single electric circuit. A valid "hit" by the electric weapon onto the lame or mask closes the circuit and causes a light to turn on. The jacket and mask are connected electronically to a scoring machine so "hits" can be registered electronically when the tip of the blade makes contact with the lame or mask. A hit is registered only when the push button is hit by a force of the specified minimum magnitude and remains fully depressed for the specified duration.

In fencing with foils and epées only hits made by the tip of the blade count. In fencing with sabres, any contact between any part of the blade and any part of the target counts. Alternative scoring systems involve a normally closed electrical circuit with a break in the circuit opening the circuit and illuminating a light.

The limitation of this type of electronic scoring system is that it only measures when contact has been made, it does not determine the location on the body of the strike or the strength of the striking force. This limits its usefulness in relation to other forms of martial arts in which electronically scoring the location of the hit and the force of the strike would be useful and also to weaponry-based martial arts where it might be preferable in some circumstances to measure the potential "damage" inflicted on an opponent rather than only recording that contact has been made.

Other limitations of electronic scoring systems such as used in fencing include:

a. the "scoring circuit" (formed by the jacket, mask and electric weapon) is specific to the particular martial art. For example, in foil fencing, the target area (and hence lame) is restricted to the torso, while in epée fencing the target area includes the entire body, and in sabre fencing the target area is the "saddle line"—from one side of the hip to the other and up, including the head but not the hands. The "scoring circuit" is limited to the target area relevant to one art and not another, and hence is unable to register hits outside the target area of one art but within the target area of another art.
b. the weapon must strike the opponent before a score is registered—therefore, the risk of injury to the opponent is real, thereby limiting its usefulness in a wide range of weaponry-based martial arts where the risk of injury caused by a striking weapon is too great.
c. the ability to score is limited to contact by an electric weapon—therefore, there is limited use in martial arts where scoring involves striking by a body part (e.g. fist, elbow, foot) or non-electric (unmodified, traditional) weaponry.

Yet another disadvantage of the system used in fencing is that the pressure sensor is on the weapon itself. Forms of martial art weaponry are varied and used in a variety of ways—it is of limited use to have a weapon-based sensor since scoring includes measures beyond whether a weapon makes contact with an opponent. For example, in martial arts weapons based fighting, the techniques used are not solely with the weapon. Fists, knees, elbows, feet, shins, shoulders, forehead, fingers etc are also used. Therefore electrifying the weapon or placing sensors over the weapon is not an effective means of scoring a combat technique. Further, a weapon can be used in a variety of ways and so sensors would be required to cover all of the striking areas of the weapon. Exemplary martial art weaponry includes Guandao, Chúi, La canne, Plong, Baton francais, Shareeravadi/bamboo pole, Naboot, Hanbo, Jō, Tambo, Monk's spade, Chicken sickles, Sai, Butterfly sword, Vettukathi (sword), Krabi/crabbie, Pariser/sharp tip, Epee/edgeless, Foil/blunt tip, Taijijian, Hook sword, Muai Cad Chuke (Cord wrap), Suntetsu, Vajra Mushti, Bagh nakh/tiger claws, Shuko/Bear claws, Grip knife, Karambit, Karambit/dbl bladed, Deer horn knives, Mai sokki/(tonfa look), Kurunthadi, Tonfa, Lathi, Jitte/jute/wood sword, Tanjo, Otta, Kanabo/studded bat, Taiaha, Urumi/Chuttuval/wire whip, Chain whip/connected rods, Rope dart, Meteor hammer, Manriki-gusari, Surujin, Chang xiao ban/grain flail, Samjiegun/3 piece staff, san set sukon 3-PC staff, Kusarifundo, Tessen/fighting fan, Emeici/Emei daggers, Siangham/fighting arrow, Throwing knife, Kunai/T-dart etcetera.

Many martial arts weapons are used in conjunction with very specific forms of armor such as Kali/Escrima Armor made from steel visor and padded neck, shoulder and chest tunic, or Myunjebaegab, a bullet proof armor made of 13 layers of cotton. Armor sets such as Bogu is used in the discipline of kendo, consisting of pants and wire mask, which is quite different to other forms of martial art armory. Likewise, Dō-maru is a Japanese wrap around style suit which is particularly defined by the absence of a solid breastplate or sleeves. Dō-maru armor is wrapped around the body rather than being put on in sections. There are thousands of forms of martial arts covering most regions of the world. Therefore, there is the need for force sensing and force locating means to be applied to an armor that can be used in a variety of martial arts.

In Taekwondo, a chest plate incorporating a force platform has been used. The chest plate offers rudimentary protection to the wearer, since it is made from padded material such as cardboard or leather and therefore would not provide sufficient protection against hard weaponry. The force platform suffers the further disadvantage that it only records whether contact has been made, not the location or magnitude of the contact force.

Other systems have been proposed to measure the impact of a weapon as it strikes. For example, U.S. Pat. No. 7,278,290 requires the target to be of a solid durable substance such as steel or titanium. A layer of elasto-luminescent material composed of zinc sulfide and manganese are embedded over this durable layer. The elasto-luminescent material is designed to emit light or exhibit luminescence when elastically strained, for example when a projectile strikes the material.

Photosensitive sensors are deployed at strategic locations to allow observation and recording of the target before, during, and after impact by a projectile. These images capture the target's luminescence at impact and the projectile's impact location. The images are then transmitted to a traditional image processing system that can isolate the impact location and correlate the light wave length and intensity with a known kinetic energy value that was obtained through initial calibration of the system.

The limitations of such a system include:

1. in order to record a hit, a solid and durable impact plate such as a steel or titanium is required in the target area;
2. analysis of the luminescence data is not dynamic enough for analysis during a martial art challenge;
3. martial art competitions take place at close range where strikes can be occluded from view and the duration of luminescence on impact is transient, and therefore insufficient to overcome the problem of scoring with the naked eye;
4. repetitive striking at the same position with the same force may not produce a reproducible result on a elasto-luminescent surface; and
5. martial art armor comes in a variety of forms and it often is composed of a material that is traditional such as wood, cloth, tin, steel of particular shapes and styles. Therefore it is a limitation to have the elasto-luminescent composite material and adhere it to the underlying material.

U.S. Pat. No. 4,761,005 discloses a means for using a transducer to measure an impact by a piezoelectric signal. Specifically this patent relates to the field of evaluating combative performance and its scoring in martial arts. However, the device described in U.S. Pat. No. 4,761,005 is limited to being placed on top of or sandwiched within, a deformable material. Therefore, it is of limited use in impact-protective materials.

Each of the patents mentioned herein is expressly incorporated herein by reference in its entirety.

There is a need for an electronic scoring system for use in the martial arts that can be used across a number of martial arts, that can measure the location on the body (e.g. rib cage, jaw, throat) and magnitude of force applied (e.g. made by a weapon, a body part, or a fall), and that can double as protective armor (particularly in weapon-based martial arts) by absorbing or dissipating the force, thus providing a means for electronic scoring in martial arts without requiring the opponent to receive a damaging strike that inflicts pain, injury or worse.

It is an object of the present invention to provide an electronic scoring system for use in a variety of martial arts (including traditional styles of martial arts, mixed martial arts or the fighting arts generally) that allows an objective determination of the force, location and effectiveness of a force applied during competition, without the need for electric weaponry.

SUMMARY

According to an aspect of the invention there is provided an electronic scoring system for use in various styles of martial arts, including:

(a) armor to provide impact protection, the armor having access to sensing means for detecting force parameter data from one or more forces applied to the armor, wherein said force parameter data includes one or more of the following:
   i. magnitude data,
   ii. location data;
   iii. duration data; and (b) a scoring machine having:
   i. communication means for receiving the force parameter data from the sensing means;
   ii. tallying means for calculating one or more results using the force parameter data; and
   iii. report generating means for generating one or more reports, wherein the scoring machine is capable of generating output for display on a visual display.

According to another aspect of the invention there is provided an electronic scoring system for use in various styles of martial arts comprising:

(a) armor to provide impact protection, the armor having force at least one sensing element that is an integral part thereof, the forcing sensing element being configured so that the armor acts as a force sensor, recording and measuring contact forces and a specific location of each contact, the sensing element generating a force parameter data signal that is based on the sensed contact forces; and (b) a scoring machine having:

i. communication means for receiving the force parameter data signal from the sensing element;

ii. calculation means for calculating one or more results using the force parameter data; and iii. output means for displaying the one or more results in real time.

According to a further aspect of the invention there is provided an electronic scoring method for use in various styles of martial arts includes the steps of:

(a) detecting force parameter data from one or more forces applied to the armor that is configured to be worn by a user, wherein the armor provides impact protection;

(b) communicating the force parameter data to a scoring machine; and (c) calculating a result using the force parameter data.

The invention thus provides an electronic scoring system for use in various styles of martial arts, and which overcomes the problems of prior art electronic scoring systems by providing a means for measuring the magnitude and location of any force applied to the armor (e.g. a strike, blow, throw), without the need for electric weaponry.

BRIEF DESCRIPTION OF THE DRAWINGS FIGURES

For a better understanding of the invention and to show how it may be performed, a preferred embodiment will now be described by way of non-limiting example only, by reference to the accompanying diagrams.

DETAILED DESCRIPTION OF EXEMPLARY EMBODIMENTS

Figure 1:
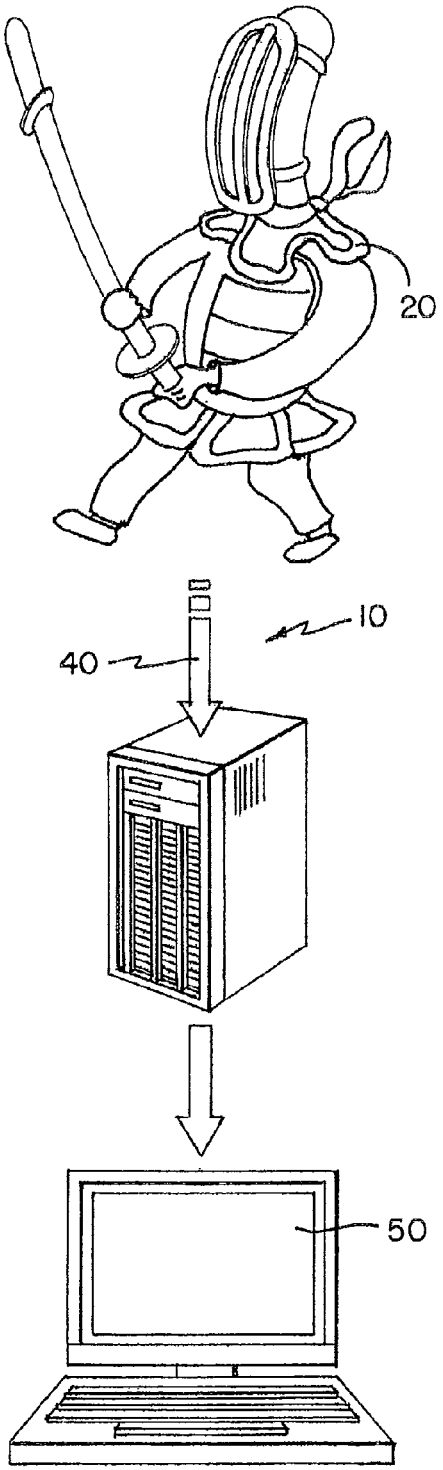
FIG. 1 is a schematic diagram showing an electronic scoring system and an armor for use in the martial arts according to the invention.

The present invention provides a new or alternative electronic scoring system (see item 10, FIG. 1) and method, and an armor for use in martial arts (including traditional styles of martial arts, mixed martial arts or the fighting arts generally).

In a preferred embodiment, the armor is an impact-protecting universal armor, for use in various styles of martial arts. The armor 20:

(a) has access to force sensing means, such as force sensors on or in the armor;

(b) provides impact protection, including puncture and tear resistant properties to protect the wearer against injury caused by impact (e.g. a strike, a throw or other force applied to a competitor, including forces from the competitor falling onto the ground or a retaining wall around the fighting arena), puncture (e.g. caused by a weapon) or shear force, and/or the impact of a weapon, body part or any other object (e.g. the ground) striking the competitor); and (c) is capable of communicating with a scoring machine 30 (such as a computer or other processing device), so that force parameter data (e.g. location, magnitude and duration of force applied) of any force applied to the armor can be electronically recorded and measured (including without limitation in real time or near real time) by the scoring machine.

In a preferred embodiment, the electronic scoring system includes:

(a) universal armor having access to force-sensing means for detecting and measuring force parameter data;

(b) a scoring machine (having processing capacity) 30 including:

i. communication means 40 for communicating with the armor so that force parameter data from the armor can be received, recorded and tallied by the scoring machine;

ii. tallying means (not shown) for tallying force parameter data, calculating one or more scores (e.g. individual competitor scores, overall competition scores, score break-downs);

iii. report generating means for generating competition reports (including one or more of overall competition score reports, individual competitor scores and score break-down reports, individual competitor strike data reports, competitor analysis reports); and iv. a visual display 50 for displaying data output (including competition reports) from the scoring machine, such as force parameter data. In some embodiments, the visual display is also capable of displaying one or more results such as one or more competitor scores, or other output from the scoring machine, including video imagery of competition and computer generated imagery (CGI).

Figure 2:
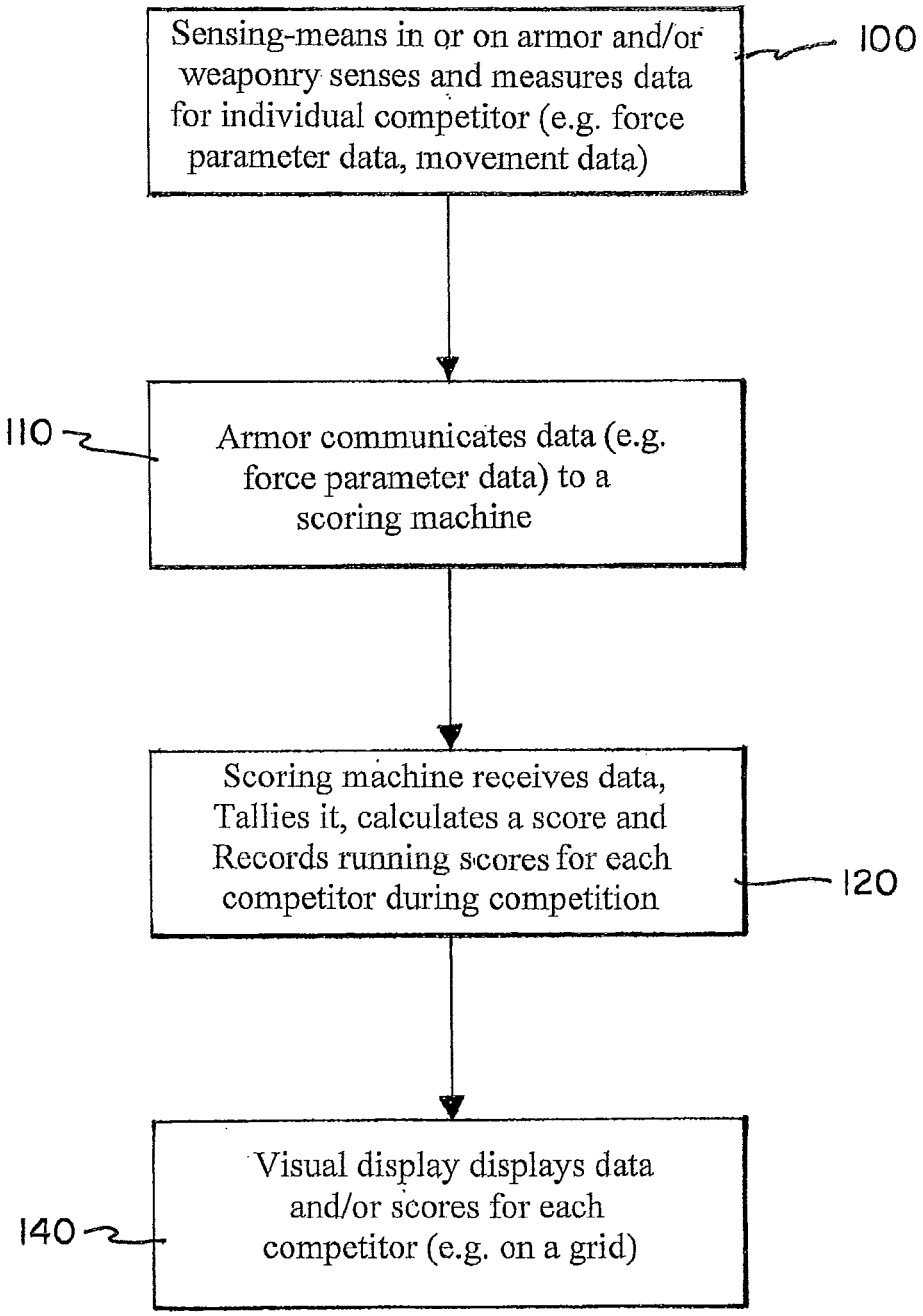
FIG. 2 is a flowchart showing the steps involved in recording data during competition, converting data to a score, and displaying the score using the electronic scoring system and armor of FIG. 1.

FIG. 2 illustrates the flow of information from the armor to the scoring machine in a preferred embodiment. The preferred embodiment of the electronic scoring method includes the steps of:

(a) detecting force parameter data from one or more forces applied to armor worn by a competitor (step 100);

(b) communicating the force parameter data to a scoring machine (step 110);

(c) calculating a result using the force parameter data (step 120). In one arrangement, the result is a score including one or more of the following:

i. one or more point(s) accumulation;

ii. one or more point(s) deduction.

As described herein, the electronic scoring method can include the step of visually displaying data and/or scores for each competitor on a visual display or the like (step 140).

An example of a scoring machine is a computer, including a computer system or network (including a LAN, WAN, the internet or cloud) or any other device (e.g. embedded hardware) with processing capacity and the ability to send data to a visual display (including without limitation in real time or near real time). The scoring machine is enabled to communicate with each competitor. In its minimum configuration, the scoring system enables force sensor data to be communicated from each competitor to the scoring machine. The scoring machine utlilises a scoring software application to perform the electronic scoring method, including collating, processing, analysing and reporting force parameter data and calculating one or more results such as scores, and is capable of generating output for display on a visual display. The scoring software application can be housed on a computer, server, or be network-, internet- or cloud-enabled.

The scoring system typically (but not necessarily) further includes audio means, to enable audio data (e.g. voice) to be received (e.g. from the scoring machine or from an external connected source) by one or more speakers such that it can be heard by one or more of the competitors, a coach or team leader, an audience (whether located locally at the fighting arena or located and viewing the competition remotely).

In other embodiments, the scoring system further includes one or more of the following:

(a) position-sensing means to allow delivery of location-based services such as locating and tracking the position of individual competitors and delivering position data to the scoring machine, for competition and game play, and later analysis for review and training purposes;

(b) security means for securing communications from the armor so that data detection by various sensors (e.g. the force sensors) and communication to the scoring machine is secure (e.g. protected from tampering by third parties);

(c) security means for securing communications (including the viewing of competition and associated CGI, and accessing associated audio data—e.g. commentary, coaching and competitor communications, announcements, music, scripting). This enables subscription-based access to the competition and competition data;

(d) superslow motion video replay means (e.g. recording at 100 frames per second slowed to 1 frame per second) enabled to be viewed on the visual display; and (e) motion-sensing means to enable visualisation and recording of the movement of competitors and/or weapons (or parts thereof), including staffs, swords, clubs, shields, projectile weapons (e.g. arrows, crossbow bolts, paintballs), fencing weapons or any other weapon suitable for use in the martial arts or fighting arts.

Communication Means

In its simplest arrangement, the scoring system includes unidirectional communication means 40, to enable communication from the armor 20 so that force detected by the force sensors in or on the armor is sent to the scoring machine 30 (as outlined in the preceding paragraph).

In another arrangement, the communication means 40 are multidirectional. In this arrangement, the scoring system allows data from the scoring machine to be communicated back to the competitor (e.g. cumulative score, or force parameter data relating to each strike, blow, throw, fall, etc, or voice data from a coach).

The communication means is uni-channel or multichannel, depending on the preferred arrangement. Multichannel communications enable simultaneous communications to be sent and/or received simultaneously.

For example, in one arrangement, the armor includes headphones in or on a helmet portion of the armor so that the competitor can receive instructions from a coach on one channel. The competitor can communicate back to the coach via a microphone located in, on or near the helmet portion of the armor. This communication is conveyed on a second channel. If there are multiple competitors involved in competition (say, in team competition), additional channels are included so that teams of competitors on the fighting arena can communicate among themselves.

In one embodiment, the communications are carried on secure channels so they are received (e.g. viewed or heard) in a secure environment. For example, a viewing audience can be provided access to, say, coach-competitor communications on a user-pays basis. A coach or competitor can select a different channel for private communications from which the paying audience is excluded access.

The secure communication means allows subscription-based access on a user pays basis, including options for selectively receiving one or more channels of data (e.g. for a fee per channel or fee per view basis, or a combination thereof).

In another embodiment, the system further comprises a CGI means (e.g. software) for graphically representing force parameter data and for multidimensional rendering of competition, including any one or more of the elements of competition such as competitors, weaponry, the fighting arena, and/or simulation or re-creation of strikes, blows, throws, falls to visually depict the force and location of impact on the visual display.

Armor

The armor is "intelligent" by virtue of the fact that, in its simplest configuration, it possesses force-sensing properties (described later), such as access to force-sensing means, for detecting force applied to the armor. In some embodiments, it also possesses motion-sensing properties, in-built electrical circuitry and other components (also described later).

The armor is also "universal" in the sense that it is suitable for use across a plurality of martial arts styles and mixed martial arts.

The armor 20 covers one or more of areas of the body, including the torso, the head and neck, and/or the limbs. In the simplest arrangement, the armor covers the head and neck. However, in other arrangements, the armor covers the head, neck and torso, or the entire body. This is essential in weaponry-focused martial arts.

In the preferred embodiment, the armor 20 is made from an impact-protection material (described in further detail below) that acts to protect a competitor (the wearer of the material) from injury by absorbing or spreading the impact forces and preventing penetration or deformation by weaponry. In its simplest configuration, the impact-protection material is a simple steel, carbon fibre or Kevlar. In other embodiments, the impact-protection material is an intelligent material or coating with force-absorbing or force-dissipating properties.

The protective armor 20 of the preferred embodiment also has force sensing properties—hence making the armor "intelligent". This enables the armor to act as a force sensor, recording and measuring contact forces and the specific location of contact or contacts, and sending this data to a computerised scoring software application, hardware, system or network ("scoring machine") in real time.

In other embodiments, the armor includes one or more of the following additional further features:

(a) in-built electronic circuitry for driving components of the armor that require power (e.g. a light, a camera as described below)—this can be provided by nanomaterials such as carbon or silicone nanotubes (e.g. buckytubes) or nanospheres (e.g. buckyballs) or other similarly electroconductive nanomaterial;

(b) one or more headphones in or on a helmet segment of the armor to enable the competitor (wearer) to receive and hear audio data;

(c) a microphone in, on or near the helmet segment of the armor, to enable the audio data (e.g. speech) to be sent from the competitor (wearer) to, say, the scoring machine, or coach, audience, team members, or an opponent;

(d) motion-sensing means, including accelerometer(s), light-based motion-capture sensors, or heat-emitting and heat-sensing means, or any other suitable motion capture technology, to enable detection of the magnitude and direction of movement of the competitor (e.g. when thrown);

(e) location-based services to enable positioning of individual competitors to be recorded—this has particular application for team competition (described later) and for subsequent analysis of combat for training purposes;

(f) one or more cameras in or on the armor (for example, on the helmet portion) to record different viewing perspectives, the data being sent from the camera(s) to, say, the scoring machine visual display so that an audience can view competition from, say, the view from the competitor's eyes, and/or the view from the back of the competitor's head (a 'rear view');

(g) one or more light-emitting means 240 positioned on or in the helmet, close to the competitor's eyes and triggered to flash when the intelligent armor detects a force of a particular threshold magnitude and location. The light-emitting means 240 simulates the visual effects of being stunned in competition, e.g. temporarily distracting or blocking the recipient competitor's vision, a classic 'set up' enabling a knock out strike to then be delivered while that competitor is "stunned". Although a competitor wearing intelligent armor will not be knocked out, the electronic scoring method takes into account successive strikes so that a flash-triggering strike (stun force) delivered near simultaneously or shortly before a force that would be sufficient to knock out the other competitor may result in a points score advantage to the competitor delivering the theoretical knock-out strike or a points score deduction from the competitor receiving the strike.

Sensing Means

Figure 5:
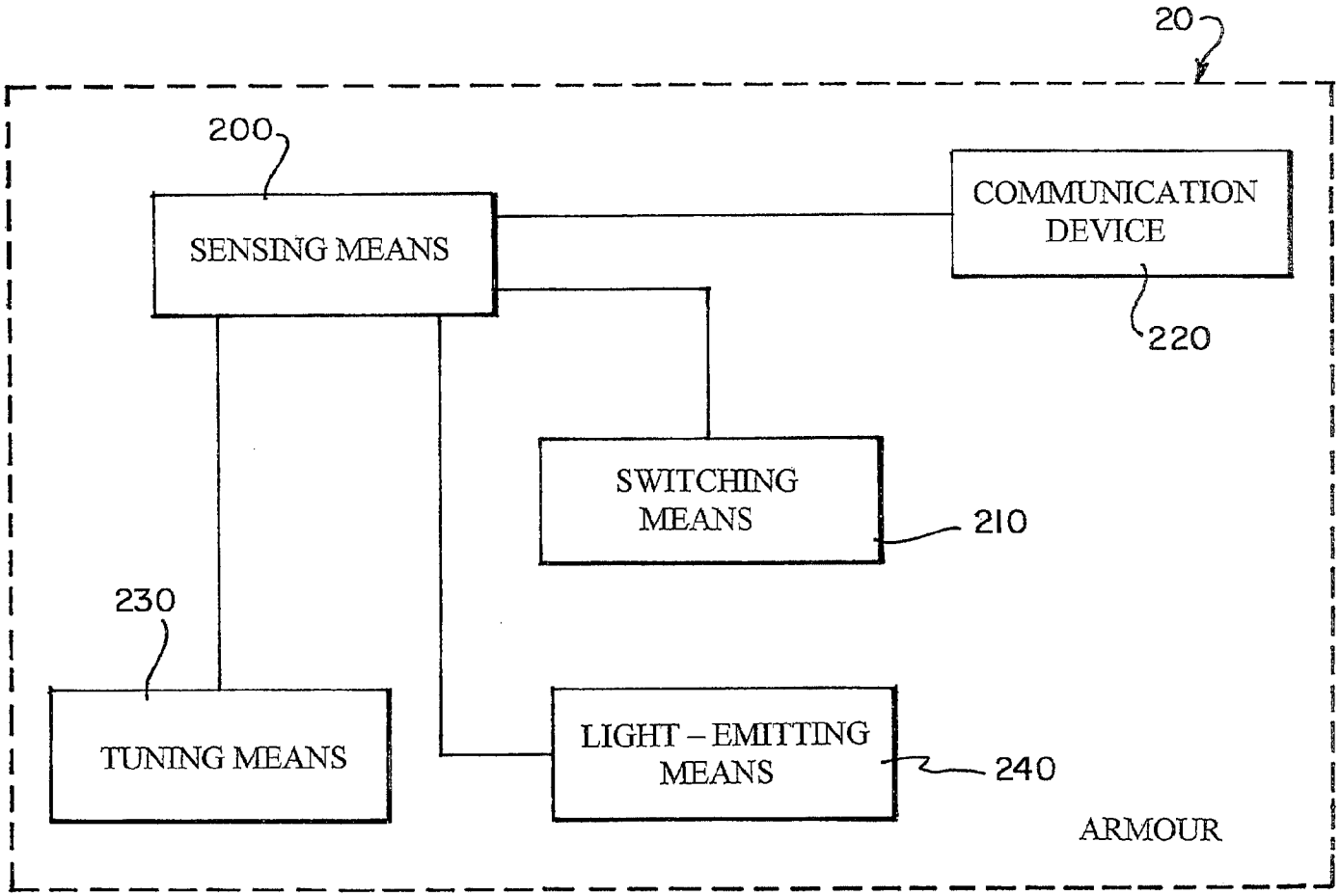
FIG. 5 is a schematic diagram showing various components, including sensing means, that are associated with the armor of FIG. 1.

In the preferred embodiment, the armor 20 has access to force-sensing means 200 (FIG. 5) such as force sensors to enable forces applied to the armor, or any part of it, to be sensed, located and measured by a scoring machine (e.g. a computer). The force sensing properties of the armor are provided by a sensing means embedded into, or layered upon, or lined within, the armor to ascertain the force and the position of a strike made to the armor. In another embodiment, the sensing means 200 is embedded in a skin worn over a traditional armor.

In one arrangement of the preferred embodiment, the sensing means 200 is a plurality of force sensors (e.g. a force sensing material, a force conducting polymer, a shape memory alloy, or other force sensors) embedded in or on the armor, connected in arrays. Each array is connected to a communication device, forming a module. There may be a plurality of modules weaved through a containing fabric such as armor-covering material. The sensing means (sensors, array and/or modules) communicates force parameter data to the scoring machine.

The sensing means 200 further includes a switching mechanism 210, enabling the arrays and/or modules to be switched on either directly or indirectly when the force sensors detect an impacting force. The advantage of this dynamic switching is that not all sensors, arrays and/or modules need to be activated at all times. Consequently, the frequency of monitoring can be increased by measuring only from active sensors/arrays/modules rather than monitoring all sensors/arrays/modules at all times.

An array, matrix or plurality of sensing means 200 is important because martial arts challenges are performed at extreme speeds and in flurries of action. Traditional scoring systems are often subjective and at best, an estimate only. A plurality of sensors enables detection of forces applied in quick succession (e.g. strikes) and allows recording of simultaneous or near-simultaneous forces that are difficult to detect visually. It also enables forces from throws and falls to be recorded and taken into account in competitors' scores. The scoring system may include the dynamic scanning of the array using parallel control circuits in a modular fashion.

The scoring machine (e.g. computer or other processing device) collects data from a plurality of sensors 200. The sensors are arranged in arrays, the arrays are further arranged in modules, and each module is capable of connecting to one or more other modules.

The signal from an array of force sensors is multiplexed—that is, converged into an individual signal over a shared medium (e.g. communication means to the scoring machine). When the multiplexed signal reaches the scoring machine it will be de-multiplexed back into multiple discrete signals from discrete sensors. This improves the sampling rate and resolution of the signal from the force sensors to be optimised.

The force sensors convert the mechanical impact into a piezoelectric signal that can be viewed on a visual display of a scoring machine (e.g. a computer or other device with processing capability). Additionally or in the alternative, the piezoelectric signal drives an audible sound and/or visible light.

There are many forces that are experienced in combat such as shear forces and flexural forces, which are critical forces in determining the outcome in combat, and therefore the elasticity in all dimensions must be converted to a piezo-electric signal. Therefore, the measurement of force, pressure, and acceleration at many locations on the armor is enabled.

Force sensors include piezoelectric sensors or other pressure sensors—for example, the piezoresistive force sensors (made by a variety of companies), which are flexible, thin (typically less than the 0.2 mm) and able to sense pressures in the range of 0.1 pounds per square inch (PSI) to 2000 PSI.

Force sensors also include tactile sensors in the form of conductive cloth-based conductive sensory arrays consisting of a plurality of parallel electrodes threaded through material that can be stretched in multiple directions so as to provide information about pressure distribution along a surface.

Force sensors may further include a shape memory alloy (SMA) whose resistance changes with deflection such that a piezoelectric signal is generated. SMAs are metal alloys that "remember" their shape, and can be returned to that shape after being deformed. As the shape alloy deforms, the impedance of the SMA alters and therefore a measurement of deformation (as a function of force) is able to be monitored at its specific location.

SMAs provide a means to measure a variety of forces including compression, shear and flexural forces.

In the preferred embodiment, the force sensors send data (force parameter data) to the electronic scoring system and enable real-time visualisation of force parameters. The data may take the form of raw data or be graphically displayed in the form of a pressure plot displayed on the visual display. The visual display of a scoring machine such as a computer receives force parameter data from the force sensors and displays the data visually in real time on the pressure plot.

In an alternative embodiment, the visual display also shows a CGI rendering of the anatomy of the competitor, illustrating where the force was applied. For example, a rendering of the competitor shows where a strike occurred (e.g. an impression of a staff, weapon or other object such as a baseball bat striking the jaw), superimposed by a multidimensional representation of the force and power of the strike. The "damage value" of the strike is also able to be represented as points for the competitor delivering the strike, one or more points deduction for the competitor receiving the strike or a combination. In one embodiment damage value is further represented as a visual rendering of the strike, say, such as an artistic impression of a staff or baseball bat striking a jaw with a corresponding pressure plot showing the relative distribution of forces across the recipient's jaw. Damage value could be further represented as a visual rendering of the strike, again say as an artistic impression, but recalibrated to simulate an edged weapon strike (e.g. virtually replacing the staff with a sword or spear).

The force sensors are capable of being linked by tuning means 230. The tuning means 230 can take the form of one or more hardwired sensor-biasing circuits or a software-enabled means. This tuning means 230 defines the force to voltage relationship for each sensor so that the sensitivity of force sensors is uniform across one or more arrays. This also provides a means of adjusting the signal (including buffering, correcting and/or amplifying the signal) so communication links from different modules can be fully interpreted.

Impact-Protection Property of the Armor

The armor has impact-protection properties. This is provided by an impact-protection material used to make the armor, an impact-protection coating, or lining, or a combination thereof. Any suitable impact-protection material (e.g. steel, carbon fibre or Kevlar) can be used for the armor.

For example, the armor can be made of an impact-protection material or suitable multifunctional electro-active material with sensing properties, including any of the following individually or in combination:

(a) a shear-thickening or dilatant material or polymer that transforms from a flexible material under normal conditions to a rigid material in response to a shearing force or impact;

(b) a magnetorheological material that transforms from a flexible armor to an extremely stiff material when a magnetic field is applied or interrupted;

(c) a shape memory alloy embedded in the armor;

(d) a ballistic material such as spun ultra high molecular weight polyethylene bonded into sheets and layered at angles to produce a composite material with puncture resistant properties, suitably coated to achieve force sensing properties (e.g. with a conducting substance such as a conducting polymer); and/or (e) a nanomaterial or coating. This allows electronic circuitry to be interwoven into the fabric to enable wireless communication or to allow power to be delivered to drive other components (e.g. a camera or light-emitting means);

(f) a power source such as a rechargeable battery in a thin film and flexible form—this includes, for example, flexible film batteries having an integrated circuit card, housing memory storage and microprocessing capabilities.

Universal Nature of the Armor

In a preferred embodiment, the armor is a universal armor for use in almost any martial art (e.g. worn over the traditional uniform). This enables measurement of the magnitude and location of forces in a variety of martial arts styles, using various weapons or no weapons, all while still protecting competitors.

By providing a universal armor, the preferred embodiment is useful for "cage fighting" (mixed martial arts competition) as well as various forms of martial arts, not confined to a specific form of martial art.

In an alternative embodiment, the armor can take the form of a traditional uniform used in a particular martial art. Hence, the armor may be a traditional uniform made from an intelligent textile with suitable properties or a traditional uniform coated with a suitable material to give it the required properties such as impact-protection, force-sensing, electroconductive and so on.

Force Parameter Data

Figure 3:
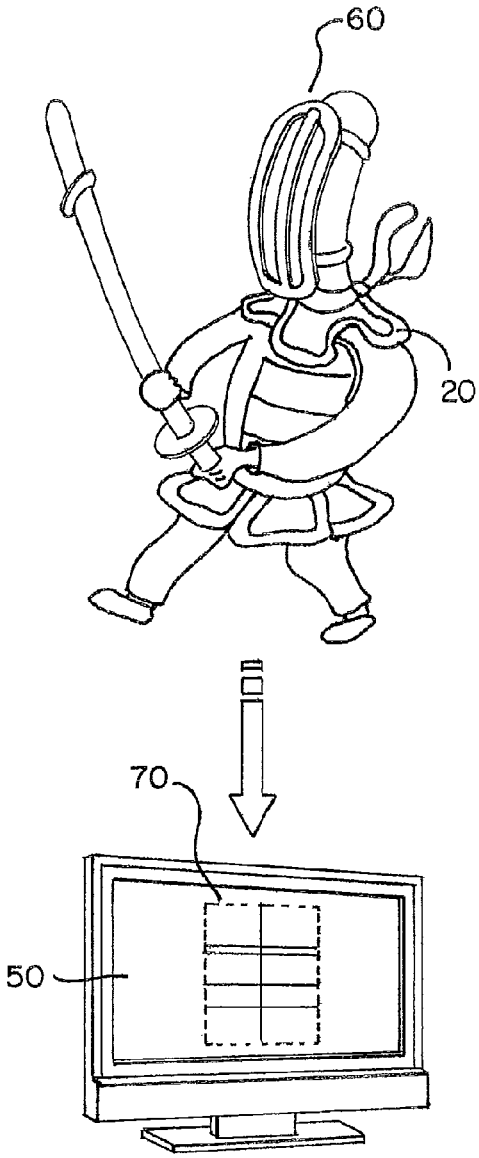
FIG. 3 is a schematic diagram showing how the armor of FIG. 1 may be segmented so that the location of forces can be recorded by reference to a corresponding segment of the armor—such as plotted against a scoring grid as exemplified in FIG. 4.

In any arrangement, the armor is divided into segments (see item 60, FIG. 3) so that different segments or portions of the armor correspond to different parts of the body (see FIG. 3). This enables the magnitude and location of force applied to the armor (force parameter data) to be recorded by reference to pre-determined anatomical regions or mapped against grid co-ordinates on a scoring grid (see item 70, FIG. 3) corresponding to armor segments and that can be displayed on the scoring machine visual display 50.

Unlike prior art electronic scoring as used in fencing, the preferred embodiment records the specific location of combative forces applied using any means (e.g. traditional weaponry or a body part). This is important to assess the "damage value" of a strike. For example, the strike force can be light but targeted so that it blocks blood or air supply (e.g. by collapsing the oesophagus) and therefore is crippling to an opponent. Conversely, a strike may be delivered with extreme power, also inflicting significant damage to an opponent (e.g. breaking the neck).

Winning in martial arts combat relies on, amongst other things, the ability to make contact with the opponent's head or body with sufficient force and technique to cause damage or injury without sustaining injury yourself. It is an advantage over the prior art to be able to record with specificity the location of strikes and the differentiation of force applied not only from use of body parts to attack (such as fists, knees and elbows) but also from weaponry; and for the armor to be able to withstand the impacts from multiple and repeated weapon strikes and to retain the ability to record the data from these strikes. This is because in real martial arts combat, avoiding strikes, preparing for a counterstrike and striking with sufficient force and technique are all part of competition, not only landing a strike within a target area.

Scoring depends on the efficiency with which a competitor can deliver a blow, as measured by the total duration of the impact and by the force delivered such that force divided by time gives the measurement of power. Critical also is the location of the impact and the angle of the attack, and other qualitative indicators such as glancing blows versus direct hits. In martial arts, skills have been measured in an algorithmic manner taking into account force, space (distance from opponent and impact area—e.g. this distance has been measured among Taekwondo competitors and found to lead to significant differences in kicking impact generated by non-expert competitors) and time. Electronic scoring systems as used in fencing are unable to take into account these additional factors.

Electronic Scoring System and Method

Figure 4B:
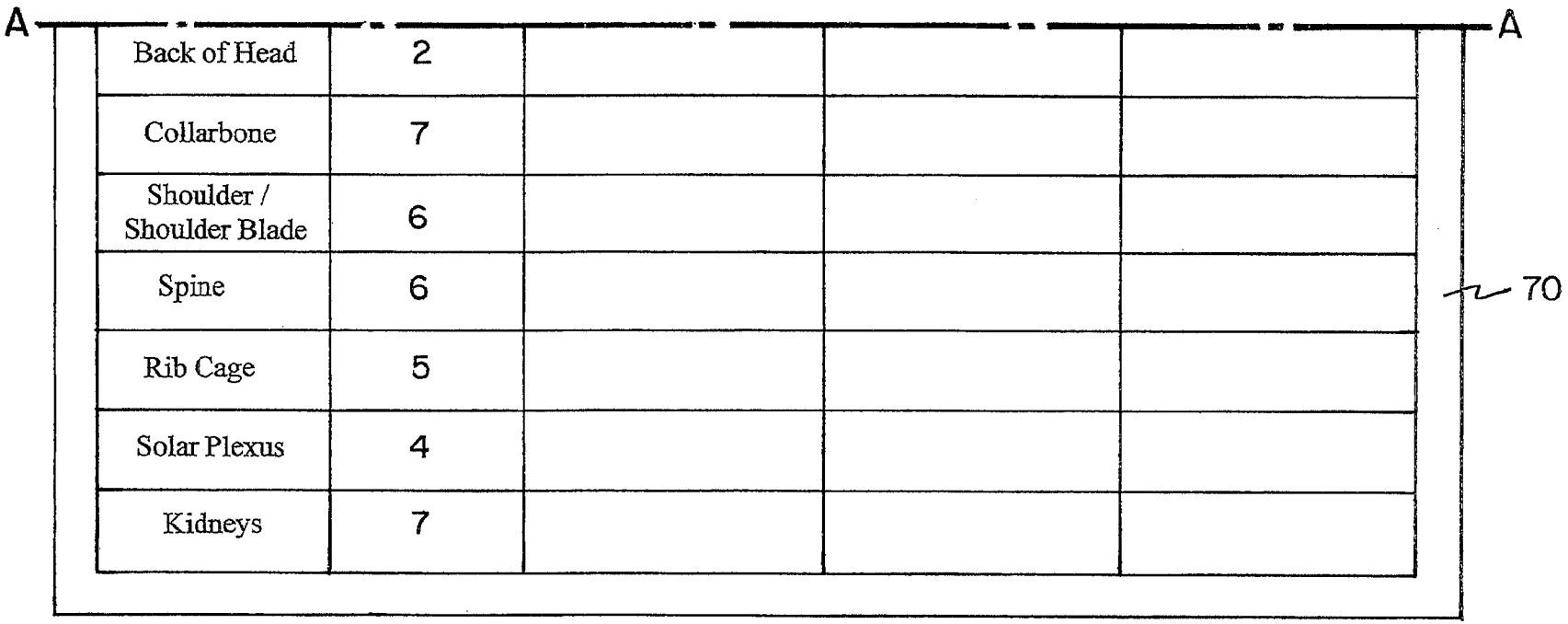
FIG. 4 is an exemplary representation of a scoring grid according to one embodiment. The grid illustrates the strike location (i.e. the location of forces applied to the armor) for a theoretical competitor.

Force parameter data recorded by force-sensing means such as force sensors in or on the armor are received by the scoring machine such as a computer, which calculates one or more results, such as scores plotted against a scoring grid 70 for each individual competitor (see FIG. 4), thereby providing useful visual means for tracking the performance of individual competitors, including individual strengths and weaknesses in competition (e.g. relative weakness in left upper thoracic strikes). The system also records who hit first and what happened (additionally to how hard).

The scoring machines in another arrangement can also calculate one or more results in the form of the "damage value" of individual forces (e.g. strikes, throws, falls). Damage value can be "raw" or calibrated according to the physical attributes of an individual. For example, a featherweight competitor competing against a heavyweight competitor will suffer greater "damage value" for a strike of the same force made by the same weapon. This can be used to calibrate the lightweight competitor's scoring so that greater damage value (e.g. one or more points deduction) will occur for the same force. Conversely, it can be used to weight a strike so that the same strike force applied to the heavyweight competitor will have greater "damage value" than if applied to the lightweight competitor (a form of "handicapping"). Alternatively calibration can interpret the result of a strike as if it had it been effected with a sharp weapon (e.g. a sword or spear) versus a staff or baseball bat and render the result as an artist's impression using CGI.

The "damage value" of a force applied (e.g. a strike or a throw) is also able to be converted into a scoring advantage or disadvantage—for example, one or more points for the competitor delivering the strike, or one or more points deduction for the competitor receiving the strike, or a combination thereof. In one embodiment damage value is further represented as a visual rendering of the strike, say, such as an artistic impression of a fist striking a jaw with a corresponding pressure plot showing the relative distribution of forces across the recipient's jaw.

The scoring machine 30 receives force parameter data in real time from the armor 20, which is electronically connected (e.g. by wireless communications means) to the scoring machine 30. Force parameters include, for example, the location and magnitude of the force applied, and the power with which the force is applied (power=force/time) for all forces applied to the armor of a competitor. This is converted by the scoring machine into a result, such as a point score for the competitor inflicting the strike or a point deduction for the competitor receiving the strike. This further allows a result such as the "damage value" of a combat strike to be calculated (based on an algorithm that takes into account force, power, location of a strike and other specified parameters) and also to be displayed to an audience along with actual and accumulated scoring. The algorithm may be enabled by software and/or hardware devices.

The electronic scoring system includes communication means 220 that are capable of receiving and recording force parameter data from various parts of the armor and relaying the data to the scoring machine. The communication means 220 can include any suitable form of communication, whether wired or wireless. The communication means 220 may involve electronically conductive armor or other means.

The advantage over prior art electronic scoring systems as used in fencing is that strikes made using unmodified weaponry can be recorded and measured, as can strikes made by any body part. By contrast, prior art electronic scoring systems as used in fencing can only record a score when an electric weapon makes contact with electronically conductive protective clothing. Thus a strike made by a body part or by a traditional (non-electric) weapon would not trigger the scoring system to score.

Another advantage over the prior art is that the specific location and force (and/or power) of the strike can be recorded. By contrast, prior art electronic scoring systems as used in fencing are simply triggered on (or remain off if the trigger does not exceed a threshold value) to indicate that contact anywhere in the target area was made.

The communication means acts as a transmitter to transmit, say, a pressure signal from force sensors to a receiving device (e.g. a computer that functions as a scoring machine). Similarly, data from other sensing means in different embodiments (e.g. motion-sensing means, heat-sensing means) are transmitted via the communication means to the scoring machine.

In the preferred embodiment, the scoring machine is connected to or contains a processing means to interpret the data signal(s) and calculate a score (or other information) according to a scoring regime or other specified algorithm. In other embodiments, the system also includes CGI means capable of receiving data from the scoring machine so that competition data can be referenced, analysed and applied by the CGI means.

The means of transmission between the transmitter and receiver is via wireless communications such as radio-frequency communication or other communication such as infrared, Bluetooth, or near-field communication or any other suitable communication protocol.

The sensors are attached to an interface device to enable the input data (sensor signals) from the armor to be interpreted by the scoring machine (receiving device). The interface has the sensitivity to dynamically and accurately record combat strikes in real time. This enables the scoring machine to take in sensor data, apply it to a scoring regimen, calculate a score and display it.

CGI Means

The "scoring machine" has processing capacity. In one embodiment, it includes capacity for processing of computer graphics, including video. In one arrangement, combat can be viewed in real time, with strike data overlays or other display of strike data, action replay and computer generated graphic visualisation of strike "damage" indicating where a competitor has been hit and the value of damage to the competitor from each hit, or cumulatively. The CGI means (e.g. software) may additionally include glyphs to enable scene display, combat targets and other visual display elements, for combat replay, modelling or game play.

In one embodiment, the scoring system includes CGI means (e.g. software) for graphically displaying force parameter data and for multidimensional (e.g. 2D, 3D, 4D) rendering of computer generated imagery relating to competition. This is useful for real and simulated competition, and for combinations of real and simulated competition. In this way, the system enhances the viewer experience when watching competition through visual display of, for example, the simulated magnitude or "damage value" of a strike if the competitor had not been wearing the armor. This can occur in any time frame—for example, in real time or as a projection into the future, or during an action replay. It may appear as a graphic overlay over video recordings of a competitor or as a CGI rendering of a competitor.

For example, consider competition between two competitors in which a first competitor is struck by a second with sufficient force to knock out the first competitor. The first competitor is wearing armor, so is in fact not knocked out. The scoring system registers, however, that the "knockout" strike was made to the temple, with a force of, say 1200 pounds per square inch (PSI). In unprotected competition, the first competitor would be taken out of competition.

On a visual display connected directly or indirectly to the scoring machine, the visual representation of the first competitor shows the competitor (e.g. in a non-armored state) taking the "knock out" strike from say a staff, CGI of the competitor's head shows the location of the strike, an artistic rendering of the staff making an "impression" on the temple at the point of strike and a corresponding graphical representation of the various forces over time and/or over distance (e.g. along the skull), and the effect of the strike (e.g. the head is thrown back and the competitor falls).

Similarly the scoring machine can interpret the result of a strike as if it had it been effected with a sharp weapon (e.g. a sword or spear) not the specific weapon actually used, and render the result as an artist's impression using CGI. For example, using the CGI means a visual simulation of the damage can be provided, so that an audience or viewer can see a representation of competitors (e.g. in a non-armored state) and the degree of damage that would have been sustained had, say, an edged weapon been used rather than a non-edged weapon, based on the same force data but recalibrated by the scoring machine (e.g. computer) for a different entertainment experience. This visual simulation includes an anatomical representation of a competitor's body and a theoretical effect of the force applied. The theoretical effect further includes one or more of the following: (a) displacement of a body part in a direction of the force applied; (b) breaking of a bone; (c) tissue damage; (d) organ damage; (e) fluid loss; and (f) reaction by the competitor to damage. Multiple strikes or forces, including simultaneous strikes of forces, can be recorded and viewed simultaneously or selectively viewed on the visual display.

The CGI means thereby enables the scoring system to enhance the viewer experience, including in interactive ways and for training and/or entertainment (e.g. gaming) purposes. The CGI means can be an integrated part of the scoring system or be connected to it through any suitable communication means and using any suitable communication protocol.

Position-Sensing Means

Certain configurations of martial artists in a team in the fighting arena will have advantageous positioning, even though the team may not have superior numbers or better individual competitors. Therefore, tactical positioning (e.g. as used in chess or military combat) can be relayed to and perceived by an audience (or a coach) using location-based services (to identify the location of a competitor or object). The scoring system includes position-sensing means to allow delivery of location-based services such as the tracking of competitor position within the fighting arena (both the physical arena and the corresponding CGI-rendering of the arena).

Real-time locating systems are able to dynamically monitor and record positioning such that relative positioning of teams and competitors can be recorded and contribute towards scoring advantages. This allows securing of preferable positions or manoeuvres to be targeted for strategic advantage and to count towards competitor and/or team scores.

For example, there may be stronger or weaker positions on the fighting arena such that, say, the vulnerability of a competitor is greater in a particular position relative to competitors in an opposing team. This is useful for military or security personnel training, or combat training generally—for example, to manipulate positions and manoeuvres (a maneouvre is a combination of movement (e.g. in position) and attack used) to strategically defend or protect key persons (e.g. a politician or monarch) or to attack a target (e.g. a terror suspect). The incorporation of glyphs into the CGI representation of the fighting arena can provide an additional training means for military or security personnel, including in real time, by allowing the virtual placement of a threat or assistance into the arena. In this way, the scoring system is also useful in entertainment or gaming.

Motion-Sensing Means

In some embodiments, the scoring system includes motion-sensing means that detects movement and send data to the scoring machine (or other processing device) regarding movement relating to competition.

Any suitable motion-sensing means can be used, including one or more of the following:

(a) light-based motion sensing means (e.g. laser, infrared, ultraviolet);
(b) heat-emitting and/or heat-sensing means;
(c) an accelerometer; and/or
(d) any other suitable motion-capture or motion-sensing technology.

In some arrangements, the motion-sensing means is configured to detect movement of competitors—say by the inclusion of motion detectors on the armor. This enables the recording of, for example, the speed, direction and path of movement of a kick, a strike by a body part (e.g. fist, elbow), a throw or a fall.

In other arrangements, the motion-sensing means also detects movement of weaponry or parts of weaponry. For example, in competition combat involving projectile weaponry, e.g. arrows, crossbow bolts, paintballs, motion-sensing means are used to detect and track the trajectory of moving projectiles. In combat involving weaponry such as striking objects (e.g. swords), motion-sensing means on the objects allows the arc of movement of each weapon to be recorded, as well as the speed, direction and path of movement of the weapon. Motion-sensing means can be included on staffs, swords, clubs, shields, projectile weapons (e.g. arrows, crossbow bolts, paintballs), fencing weapons, or any other weapon or object (e.g. baseball bat) suitable for use in the martial arts or fighting arts.

The inclusion of motion-sensing means in the system enables recording and visualisation (e.g. by CGI rendering) of the movement parameters of competitors and/or weaponry. For example, the arc, speed and direction of a strike made by a body part, weapon or a projectile is superimposed on video imagery of competition or rendered for viewing on CGI rendering of the fighting arena and competitors. This is useful in enhancing the entertainment value of the viewer experience, as well as providing useful information for training and competition strategy purposes.

The invention thus provides a new or alternative electronic scoring system, method and armor for use in martial arts, particularly weapon-focused martial arts but also useful for martial arts generally, which overcome the problems of prior art electronic scoring systems, methods and armor in that they provide electronic means for measuring the potential force and specific location of any impact while protecting an opponent from a damaging strike that inflicts pain, injury or worse. However, it will be appreciated that the invention is not restricted to these particular fields of use and that it is not limited to particular embodiments or applications described herein.

The invention claimed is:

1. An electronic scoring system for use in various styles of martial arts comprising:

at least one armor providing impact protection, wherein the armor is worn by a competitor;

a scoring machine in the form of a computer that includes a processor and a display device; and wherein the armor has force sensors that are an integral part thereof, two or more of the force sensors recording and measuring force parameter data of each contact to the armor regardless of an origin of the contact, and generating a force parameter data signal that is based on one or more sensed contact forces, said force parameter data including data regarding:

i. magnitude;

ii. location;

iii. duration; and iv. direction of the one or more sensed contact forces applied to the armor;

wherein the two or more force sensors are configured to detect a specific location of the contact within a target area;

wherein the armor also has at least one motion detector that detects movement irrespective of each contact and sends movement data to the scoring machine, said motion detector being selected from the group consisting of a light-based sensor on the armor, heat-sensing sensor on the armor, and accelerometer, wherein the armor also includes a wireless transmitter for communicating competition data to the scoring machine, wherein said competition data includes said force parameter data and said movement data, wherein the scoring machine is configured to receive the competition data from the wireless transmitter and includes a software application executed by the processor for processing the competition data to:

determine, for the contact using the force parameter data from the two or more forces sensors, a distribution of forces across the specific location of the contact within the target area;

calculate one or more results including a damage value for each contact using the competition data, wherein the damage value is calculated based on a scoring algorithm that takes into account the force parameter data measured by the two or more force sensors, the distribution of forces across the specific location of the contact within the target area, and one or more of the following specified parameters:

(a) real or a theoretical physical attribute of an anatomical segment having a location within at least a portion of the specific location of the contact, and taking into account the distribution of forces across the at least a portion of the specific location;

(b) a physical attribute of said competitor relative to a corresponding physical attribute of an opponent, including a difference in weight between said competitor and said opponent; and (c) a real or a theoretical physical attribute of a force applying member, wherein the force applying member is identified from among a plurality of force applying members by the scoring machine based on the distribution of forces across the specific location of the contact, and irrespective of information concerning the contact that is provided to the scoring machine by the force applying member;

render one or more visual representations of competition, including the contact, based on said movement data and said calculated damage value; and output the one or more visual representations to the display device.

2. An electronic scoring system according to claim 1, further comprising:

a camera for the recording of video imagery of movement during competition, said camera being in communication with said scoring machine and providing slow motion video imagery to the scoring machine, and wherein said competition data includes the video imagery;

wherein said wireless transmitter includes one or more of a radio, infrared, shortwave radio, or near-field communication or any other suitable wireless transmitter suitable for in or near real-time transmission of said competition data;

wherein processing of said competition data including the calculation of said damage value, the rendering of the one of more visual representations and the output to the display device, occurs in real time or near real-time; and wherein the visual representation is further based on the movement data and the video imagery relating to movement during competition of:

(a) the competitor; and (b) any object associated with the competitor, including one or more of:

i. a sensor;

ii. a marker; and iii. a weapon or other force-applying member.

3. An electronic scoring system according to claim 2, wherein said competition data includes a combination of said force parameter data with at least one of said movement data and said video imagery recorded by said camera, and wherein the position data includes data regarding one or more of the following:

i. motion capture data;

ii. locating data; and iii. positioning data.

4. An electronic scoring system according to claim 1, wherein the scoring algorithm takes into account two or more of the specified parameters, and wherein said visual representation includes a visual simulation of the calculated damage value of one or more forces applied.

5. An electronic scoring system according to claim 4, wherein said visual simulation includes an anatomical representation of the competitor's body and a theoretical effect of the force applied, said effect including one or more of the following:

(a) displacement of a body part in a direction of the force applied;

(b) breaking of a bone;

(c) tissue damage;

(d) organ damage;

(e) fluid loss; and (f) reaction by the competitor to damage.

6. An electronic scoring system according to claim 1, wherein the scoring machine is further configured to detect position data of one or more of the following:

(a) the competitor; and (b) any other object associated with the competitor during competition.

7. An electronic scoring system according to claim 1, wherein the scoring machine calculates one or more results based on one or more of:

a. force parameter data;

b. movement data; and c. position data.

8. An electronic scoring system according to claim 7, wherein the scoring machine is further configured to calculate damage value according to a physical attribute of the identified force applying member, and wherein the plurality of force applying members include:

(a) at least one type of body part of the opponent; and (b) at least one type of weapon used by the opponent to apply the contact force during competition;

wherein the motion detector is configured to detect movement of the force applying member and wherein the force applying member is identified by the scoring machine based on the distribution of forces across the specific location of the contact, the detected movement of the force applying member, and irrespective of information concerning the contact that is provided to the scoring machine by the force applying member.

9. An electronic scoring system according to claim 1, wherein the motion detector is a light-based sensor.

10. An electronic scoring system according to claim 1, wherein the motion detector is an accelerometer.

11. An electronic scoring system for use in various styles of martial arts comprising:

a. armor to provide impact protection, wherein the armor is worn by a competitor;

b. two or more force sensors that are associated with the armor and, for each contact, are configured to measure and record force parameter data of each force applied to the armor regardless of an origin of the force, the at least two first sensors generating a force parameter data signal that is based on one or more sensed forces applied to the armor;

wherein the two or more force sensors are configured to detect a specific location of the contact within a target area;

c. at least one second sensor that is associated with the armor and is configured to measure and record data relating to the competitor irrespective of each force applied to the armor but different than the force parameter data; wherein said data includes data regarding one or more of:

i. movement of the competitor or a part thereof, wherein said movement includes a movement of the competitor relative to one or more of an opponent or a part thereof, a weapon of the opponent, and an object;

ii. position of the competitor or a part thereof, wherein said position includes a relative positioning of the competitor to the one or more of the opponent, the opponent's weapon, and the object; and iii. movement of a weapon in use by the competitor; and d. a scoring machine in the form of a computer having a processor and a display device, the scoring machine being configured to receive competition data including: (i) the force parameter data signal from the two or more force sensors; (ii) the data from the second sensor, and wherein the scoring machine is further configured to process the competition data including:

determine, for the contact using the force parameter data signal from the two or more forces sensors, a distribution of forces across the specific location of the contact within the target area;

calculate one or more results including a damage value for each contact using at least the force parameter data, wherein the damage value is calculated based on a scoring algorithm that takes into account the force parameter data measured by the two or more force sensors, the distribution of forces across the specific location of the contact within the target area, and one or more of the following specified parameters:

(a) a real or a theoretical physical attribute of a specific anatomical segment having a location within at least a portion of the specific location of the contact, and taking into account the distribution of forces across the at least a portion of the specific location;

(b) a physical attribute of said competitor relative to a corresponding physical attribute of an opponent, including a difference in weight between said competitor and said opponent; and (c) a real or a theoretical physical attribute of a force applying member, wherein the force applying member is identified from among a plurality of force applying members by the scoring machine based on the distribution of forces across the specific location of the contact, and irrespective of information concerning the contact received by the scoring machine by the force applying member; and render one or more visual representations of competition based on said movement data and said calculated damage value and to output the one or more visual representations to the display device.

12. An electronic scoring system according to claim 11, wherein the second sensor comprises one or more of:

(a) a motion detector that detects movement data regarding movement of one or more of:

i. the competitor;

ii. a force-sensor from among the two or more force sensors; and iii. the force-applying member including one or more of:

A. a weapon;

B. any other object used to apply a force during competition;

(b) a position detector that detects position data including tracking a position of one or more of:

A. the competitor;

B. the force-applying member; and

C. any other object associated with the competitor.

13. An electronic scoring system according to claim 12, wherein the motion detector is selected from the group consisting of a light-based sensor on the armor, heat-sensing sensor on the armor, and accelerometer.

14. An electronic scoring system according to claim 11, wherein the force parameter data includes data regarding:

i. magnitude;

ii. location;

iii. duration; and iv. direction of one or more forces applied to the armor.

15. An electronic scoring system according to claim 11, wherein the scoring machine is configured to render one or more visual representations of competition, the visual representations being based on one or more of:

(a) force parameter data;

(b) movement data; and (c) position data.

16. An electronic scoring system according to claim 11, wherein the armor includes built-in electronic circuitry for driving at least one component of the armor that requires power.

17. An electronic scoring system according to claim 11, wherein the scoring machine is further configured to calibrate damage value of the force according to a theoretical attribute of the identified force-applying member, wherein the force-applying member is one or more of:

i. a body part of the opponent;

ii. a weapon used to apply the force; and iii. a contact surface of a body part or a weapon used to apply the force, such that the scoring machine is enabled to calculate the damage value of the sensed contact force applied with the identified force-applying member as if the contact force had been effected with a second force-applying member that is different than the identified force-applying member that was actually used to apply the contact force.

18. An electronic scoring system for use in various styles of martial arts, comprising:

(a) armor to provide impact protection for a competitor, the armor including at least two force sensors that, for each contact, detect force parameter data from one or more forces applied to the armor regardless of an origin of the force, and wherein the two or more force sensors are configured to detect a specific location of the contact within a target area;

(b) a real-time locating system that detects position data irrespective of the one or more forces applied to the armor of one or more of:

i. the competitor;

ii. a force-applying member; and iii. any other object associated with the competitor during competition; and (c) a scoring machine in the form of a computer having a processor and a display device, the scoring machine being configured to:

receive competition data including the force parameter data from the two or more force sensors and position data from the real-time locating system, determine, for each contact using the force parameter data from the two or more forces sensors, a distribution of forces across the specific location of the contact;

calculate one or more results, including a damage value, using the competition data, wherein the damage value is calculated for each contact based on a scoring algorithm that takes into account the force parameter data measured by the two or more force sensors, the distribution of forces across the specific location of the contact within the target area, and one or more of the following specified parameters:

(a) real or a theoretical physical attribute of a anatomical segment having a location within at least a portion of the specific location of the contact, and taking into account the distribution of forces across the at least a portion of the specific location;

(b) a physical attribute of said competitor relative to a corresponding physical attribute of an opponent, including a difference in weight between said competitor and said opponent; and (c) a real or a theoretical physical attribute of a force applying member, wherein the force applying member is identified from among a plurality of force applying members by the scoring machine based on the distribution of forces across the specific location of the contact, and irrespective of information concerning the contact provided to the scoring machine by the force applying member; and render one or more visual representations of competition based on said position data and said calculated damage value and to output the one or more visual representations to a visual display.

19. An electronic scoring system according to claim 18, wherein said force parameter data includes data regarding:

i. magnitude, ii. location;

iii. duration; and iv. direction of one or more forces applied to the armor.

20. An electronic scoring system according to claim 18, wherein said position data includes data regarding one or more of the following:

i. motion capture data;

ii. locating data; and iii. positioning data.

21. An electronic scoring system according to claim 18, wherein the armor contains at least one motion detector that detects movement data regarding movement of one or more of the following:

a) the opponent;

b) any object associated with the opponent, including one or more of:

i. a sensor;

ii. a marker; and iii. the force-applying member, wherein the at least one motion detector communicates the movement data to the scoring machine such that the system is capable of detecting movement related to competition.

22. An electronic scoring system according to claim 21, wherein the movement data includes data relating to one or more of the following:

a) speed;

b) magnitude;

c) direction; and d) path of movement.

23. An electronic scoring system according to claim 18, wherein the armor includes built-in electronic circuitry for driving at least one component of the armor that requires power.

24. An electronic scoring system according to claim 23, wherein the at least one component comprises at least one of:

(a) the force sensor;

(b) a response-simulation means; and (c) a camera.

25. An electronic scoring system according to claim 18, wherein the armor is divided into segments, each segment of the armor corresponding to different grid co-ordinates on a scoring grid, such that the scoring machine is enabled to record a specific location of a force applied to the armor by reference to the corresponding grid co-ordinates.

26. An electronic scoring system according to claim 25, wherein the scoring machine calculates a damage value based on one or more of:

i. force parameter data;

ii. movement data; and iii. position data.

27. An electronic scoring system according to claim 18, further including a response simulation means coupled to the armor, the response simulation means being activated when the force sensor detects a force of a particular threshold damage value, the damage value being calculated based on a combination of force parameter data including two or more of the following:

a) magnitude;

b) location;

c) duration; and d) direction of one or more forces applied to the armor, and wherein the response simulation means simulates at least part of the effect on the competitor of being struck by a force of the calculated damage value.

28. An electronic scoring system according to claim 27, wherein the response simulation means is one or more of the following:

a) light-emitter.

29. An electronic scoring system according to claim 18, wherein the scoring machine is configured to calculate damage value of a contact force according to a physical attribute of the identified force-applying member, wherein the force-applying member is one or more of:

i. a body part of the opponent;

ii. an object used by the opponent to apply the force; and iii. a contact surface used to apply the force, such that the scoring machine is enabled to interpret a result of the contact force applied with the identified force-applying member as if the contact force has been effected with a second force-applying member that is different than the first force-applying member that was actually used to apply the contact force.

30. An electronic scoring system according to claim 29, wherein the first force generating member comprises a non-edged weapon and the second force generating member comprises an edged weapon.

31. An electronic scoring system according to claim 18, wherein the scoring machine is configured to render one or more visual representations of competition, the visual representations being based on force parameter data relating to one or more forces applied.

32. An electronic scoring system according claim 31, wherein the visual representation is further based on movement data relating to movement of the competitor.

33. An electronic scoring system according to claim 31, wherein said visual representation includes a visual simulation of the damage value of the one or more forces applied.

34. An electronic scoring system according to claim 33, wherein said visual simulation includes an anatomical representation of the competitor's body and a theoretical effect of the contact force applied, said effect including one or more of the following:

(a) displacement of a body part in a direction of the force applied;

(b) breaking of a bone;

(c) tissue damage;

(d) organ damage;

(e) fluid loss; and (f) reaction by the competitor to damage.

35. An electronic scoring system for use in various styles of martial arts comprising:

at least one armor providing impact protection, wherein the armor is worn by a competitor;

a scoring machine in the form of a computer that includes a processor and a display device; and wherein the armor has force sensors that are an integral part thereof, two or more of the force sensors recording and measuring force parameter data of each contact to the armor regardless of an origin of the contact, and generating a force parameter data signal that is based on one or more sensed contact forces, said force parameter data including data regarding:

i. magnitude;

ii. location;

iii. duration; and iv. direction of the one or more sensed contact forces applied to the armor;

wherein the two or more force sensors are configured to detect a specific location of the one or more sensed contact forces within one or more respective target areas;

wherein the armor also has at least one motion detector that detects movement irrespective of each contact and sends movement data to the scoring machine, said motion detector being selected from the group consisting of a light-based sensor on the armor, heat-sensing sensor on the armor, and accelerometer, wherein the armor also includes a wireless transmitter for communicating competition data to the scoring machine, wherein said competition data includes said force parameter data and said movement data, wherein the scoring machine is configured to receive the competition data from the wireless transmitter and includes a software application executed by the processor for processing the competition data including:

determining, for each contact using the force parameter data from the two or more force sensors, a distribution of forces across the specific location of the contact, identifying, for each contact and based on the specific location of the one or more sensed contact forces, a force applying member from among a plurality of force applying members, wherein the force applying member is identified irrespective of information concerning the contact provided to the scoring machine by the force applying member;

calculating one or more results including a damage value for each contact based on a scoring algorithm that takes into account the force parameter data measured by the two or more force sensors, the identified force applying member and one or more of the following specified parameters:

(a) real or a theoretical physical attribute of a anatomical segment having a location within at least a portion of the specific location of the contact, and taking into account the distribution of forces across the at least a portion of the specific location;

(b) a physical attribute of said competitor relative to a corresponding physical attribute of an opponent, including a difference in weight between said competitor and said opponent; and (c) a real or a theoretical physical attribute of the identified force applying member; and rendering one or more visual representations of competition based on said movement data and said calculated damage value and to output the one or more visual representations to the display device.

* * * * *